United States Patent [19]

O'Brien et al.

[11] Patent Number: 5,007,855

[45] Date of Patent: Apr. 16, 1991

[54] CABLE CONNECTOR

[75] Inventors: Steven T. O'Brien, Champlin; Jay J. Kakuk, Plymouth, both of Minn.

[73] Assignee: The Toro Company, Minneapolis, Minn.

[21] Appl. No.: 542,491

[22] Filed: Jun. 20, 1990

[51] Int. Cl.[5] ..... H01R 4/24

[52] U.S. Cl. ..... 439/411

[58] Field of Search ..... 439/391, 392, 395–397, 439/399, 400, 401, 406, 407, 411–413, 417, 425

[56] References Cited

U.S. PATENT DOCUMENTS

| | | | |
|---|---|---|---|
| 1,231,804 | 7/1917 | Station | 439/413 |
| 4,080,034 | 3/1978 | Werner | 439/413 |
| 4,767,354 | 8/1988 | Saligny | 439/417 |

FOREIGN PATENT DOCUMENTS

| | | | |
|---|---|---|---|
| 3715529 | 10/1988 | Fed. Rep. of Germany | 439/411 |
| 0699856 | 11/1953 | United Kingdom | 439/418 |

*Primary Examiner*—Joseph H. McGlynn
*Assistant Examiner*—Hien D. Vu
*Attorney, Agent, or Firm*—R. Lawrence Buckley

[57] ABSTRACT

A cable connector for a low voltage electrical system. A preferred connector (22) includes a pair of electrically conductive jumper elements (**62*a*, 62*b*) with a pair of spaced sharp protrusions (66) that are electrically connected. The preferred connector (22) includes a cap (52) consisting of electrically resistive material with means for engaging the jumper elements (62*a*, 62*b*). The preferred cable connector (22) includes a base (24) consisting of electrically resistive material with a plurality of channel-like cavities (26, 28, 30, 32) for accepting low voltage electrical cables (36, 38). The base (24) is sized so as to nest within cap (52) and the cavities (26, 28, 30, 32) are sized so as to receive the sharp protrusions (66) so that the cables (36, 38) are penetrated by the protrusions (66) and the base (24) nests within the cap (52). The preferred cable connector (22) also includes a fastening means for retaining cap (52) to the base (24) wherein the protrusions (66) penetrate the insulating material of the cables (36, 38) and make electrical contact with the conductive material of the cables (36, 38**).

3 Claims, 3 Drawing Sheets

CABLE CONNECTOR

Technical Field

This invention generally pertains to electrical cable connectors. Specifically, this invention pertains to insulation displacement type electrical cable connectors utilized in low voltage outdoor lighting systems.

BACKGROUND OF THE INVENTION

Low voltage outdoor lighting systems typically include several components. Among these components are an electrical transformer for converting standard household alternating current into low voltage (typically 12 volts) alternating current. Such systems also utilize various lighting fixtures which are typically mounted above ground and include sockets for low voltage electrical lamps and lenses for refracting light emitted by the lamp. The light fixtures are typically mounted or placed in the ground some distance from the power transformer which is typically located or mounted on the side of the home. The lighting fixutres are connected to, and supplied with electric current from, the transformer by a series of main and smaller feeder electrical cables that run underground from the transformer location to the various light fixture locations. In some cases, the lighting fixtures are connected, physically and electrically, directly to the main cable without any feeder cable running between the lighting fixture and the main cable. In those cases, the light fixture has means incorporated in it for directly connecting to the main cable.

Typically, one main cable runs from the transformer to the ground area where the lighting fixtures are placed. This main cable is relatively large as it must carry the total current for the sum of the lighting fixtures. However, smaller cables, that is, cables with smaller diameter conductors and insulators, are typically run from the main cable to the lighting fixture since these cables only carry current for one lamp. The cable from the lamp to the main cable is connected to the main cable by a connecting device, hereinafter called "cable connector," which physically joins the two cables to each other and also forms an electrical connection between the main cable and the cable running to the fixture. Each light fixture's feeder cable must be connected to the main cable by a cable connector.

Cable connectors are also utilized wherever it is desirable to add an additional length of main cable to the existing main cable. Additional main cable would be required whenever one wanted to add light fixtures at a location more distant from the power transformer or if one wanted to add additional light fixtures in the same area as the first set of fixtures by utilizing a "parallel" electrical circuit. The two sections of main cable would be joined by a cable connector which would physically and electrically connect the two lengths of main cable.

Since low voltage outdoor lighting systems are typically sold to consumers-homeowners who, in turn, usually install the systems themselves, it is highly desirable that the components and systems are capable of being assembled and installed with ease. The cable connectors utilized in such systems are no exception. The connections between the main and feeder cables, and between the main cables, must be capable of being completed with ease. Accordingly, cable connectors must be designed to provide reliable physical and electrical connections that can be accomplished with ease by the typical consumer-homeowner.

The majority of connectors utilized in low voltage outdoor lighting systems are of the insulation displacement type. Typical insulation displacement type connectors for low voltage lighting systems physically and electrically join two cables by utilizing a clamping type connector that incorporates electrically conductive jumper strips with integral sharp protrusions. The sharp protrusions on the jumper strips pierce through the usually soft insulating material surrounding the electrically conductive core material of the cable. The protrusions pierce through the insulating material when a clamping force is applied, by the system installer, to the two halves of the cable connector, between which lie the cables to be physically and electrically connected. The cables typically are set in channel-shaped cavities, often called cable guide channels, formed in one side of the connector wherein the cavities are sized so as to accept a particular size cable. The electrically conductive jumper strips are typically fixed upon one-half of the connector facing the cables to be clamped between the halves. The strips are fixed in position so as to both mechanically grip the cables being connected and to also electrically connect them. The mechanical connection is made by the piercing, caused by the above-mentioned clamping force transmitted to the sharp protrusions on the jumper strips, of the cable's insulating materials that surround the cable's conductive core. The electrical connection is accomplished when the clamping force transmitted to the two halves of the clamp and, thus, the jumper strips, is increased to the degree where the sharp protrusions of the integral jumper strips pierce through the insulating material and physically contact the electrically conductive core of the cable. The jumper strips, each having two sharp protrusions, are placed within the clamp halves so that the strip's protrusions engage, pierce and contact the core of the proper portions of the cables to be joined. Since each main feeder cable has an electrically charged ("hot") and neutral side to it, it is important that the jumper strips be placed and fixed on the cable connector so that the strips mechanically and electrically connect the "hot" side of the main cable to one side of the other cable and the neutral side of the main cable to the other side of the other cable. The proper alignment between the base and the cap as well as the location of the jumper strips and the corresponding channels for accepting the cables in the mating base are requisites for proper alignment of the jumper strip protrusions with the corresponding cable conductors of the cables being connected.

Various types of insulation displacement connectors have been utilized in the low voltage outdoor lighting industry to date. Each has presented problems while attempting to achieve the requisite proper alingment and clamping discussed above. Some clamps utilize a design wherein the operator must directly press the cables onto the sharp protrusions of the jumper strips so as to ensure proper alignment of the strip protrusions with the conductive core of the cable. Such a design creates obvious problems as there is no assurance or guide for proper alignment of the cable. Furthermore, the operator must exert a great deal of force directly on the cable itself without the aid of a mechanical advantage such as is developed in a typical fastener system. The large amount of force mentioned above is required so that the protrusions of the jumper strips will pierce the insulation of the cable to the point of positively, physically connecting the cables and also electrically connecting the cables through the contact of the jumper strips with the conductive cores of both cables.

Another problem encountered in previous cable connector designs arises out of the incorporation of fastening means such as a nut and machine screw combination. In such designs, the two halves of the cable connectors are designed with holes in them for accommodating the nut and machine screw fastening system. The machine screw is placed through the holes of the two cable connector halves after the cables have been aligned and placed between the halves. The nut is then placed on the machine screw and the fastener is then tightened to develop clamping force for drawing the two halves together and forcing the sharp protrusions of the jumper elements through the insulating material of the cables positioned between the connector halves. This design presents problems, though, since it is quite difficult to work with the extremely small nut and machine screw system that is typically utilized on these small cable connectors. The nut is especially prone to falling away from the connector and the installer's hands as he attempts to thread the nut onto the threaded machine screw.

Another problem with the nut and bolt system is that it is often difficult to get the nut properly started onto the threads of the machine screw due to the extremely small hardware and thread pitch used. Furthermore, the utilization of multiple fastener components adds cost to the connector as well as problems with handling and packaging.

Another problem encountered with previous cable connector designs is that the cable connectors are typically designed so as to incorporate only one fixed set of cable guide channels, which means that the cable connector can only accommodate one set of cable sizes. This, of course, means that one cable connector would be used when joining two identical size cables such as 16 gauge to 16 gauge, while a different cable connector would have to be used when connecting non-identical cables such as 16 gauge to 18 gauge.

The present invention addresses the problems associated with prior art cable connectors. In particular, a preferred cable connector according to the present invention accommodates ease of connecting low voltage electrical cables in that it incorporates a fastening means not requiring a nut and machine screw system; means for accommodating varying cable sizes, all within the same connector; and cable alignment means wherein the operator need not directly press, with great force, the cable onto the electrically conductive jumper strips.

SUMMARY OF THE INVENTION

Accordingly, the present invention includes a cable connector for mechanically and electrically connecting low voltage electrical cables. The present invention also includes a low voltage electrical system including a cable connector.

Specifically, this invention includes a low voltage cable connector for mechanically and electrically connecting low voltage electrical cables where the cables include electrically conductive cores and electrically insulating materials surrounding the cores. The cable connector includes a plurality of electrically conductive jumper elements, wherein each of the elements includes a pair of sharp protrusions where the sharp protrusions are electrically connected. The cable connector also includes a cap wherein the cap consists of electrically resistive material with means for engaging the electrically conductive jumper elements. The cable connector also includes a base wherein the base consists of electrically resistive material with a plurality of channel-like cavities for accepting the electrical cables and wherein the base is sized so as to nest within the cap and wherein the cavities on the base are positioned so as to receive the protrusions of the elements engaged in the cap when the base nests within the cap. The connector also includes a fastening means for retaining the cap to the base where the protrusions penetrate the insulating material and make electrical contact with the conductive core of the cable.

Another aspect of the invention includes a cable connector wherein the cap comprises a generally channel-like cross section with means for fixedly engaging the jumper elements and wherein the cap includes a hole for accepting a fastener. The present invention also includes jumper elements consisting of a generally channel-like cross section of electrically conductive material wherein the channel-like cross section comprises a top surface and legs wherein the legs extend perpendicularly away from the top surface and wherein the legs comprise sharp protrusions. Another aspect of the present invention includes a cable connector wherein the base of the connector comprises a generally rectangular-like cross section and wherein the base includes four cavities, two of the cavities of equal width and depth for accepting cable of equal size, extending parallel to each other on one side of the base; and two of the cavities of unequal width and depth for accepting cable of unequal size, extending off-parallel to each other along the opposite side of the base; wherein the base nests within the cap so that either set of the cavities will receive the protrusions of the jumper elements engaged in the cap, and wherein the base includes a hole for accepting a fastener. Another aspect of the present invention includes a cable connector wherein the base of the connector includes a hole to accept a self-tapping sheet metal screw. Another aspect of the present invention includes a cable connector wherein the fastener is a self-tapping sheet metal screw.

The present invention also includes a low voltage electrical system having a power source, one or more low voltage devices, a pair of low voltage electrical cables, with electrically conductive material encased in electrically insulating material, connecting the source to the low voltage electrical devices, and one or more low voltage cable connectors connecting the low voltage electrical cables to additional cables. The cable connector of this system includes a pair of electrically conductive jumper elements wherein the elements include a pair of spaced sharp protrusions wherein the sharp protrusions are electrically connected. The cable connector of this system also includes a cap wherein the cap includes electrically resistive material with means for engaging the electrically conductive jumper elements. The cable connector of this system also includes a base wherein the base consists of electrically resistant material with a plurality of channel-like cavities for accepting the electrical cables and wherein the base is sized so as to nest within the cap and wherein the cavities on the base are positioned so as to receive the protrusions such that the cables are penetrated by the protrusions when the base nests within the cap. The cable connector of this system also includes fastening means for retaining the cap to the base wherein the protrusions penetrate the insulating material and make electrical contact with the conductive core of the cable.

BRIEF DESCRIPTION OF THE DRAWINGS

The invention will be further described with reference to the appended Drawing, wherein.

DETAILED DESCRIPTION OF THE PREFERRED EMBODIMENT

Figure 1:
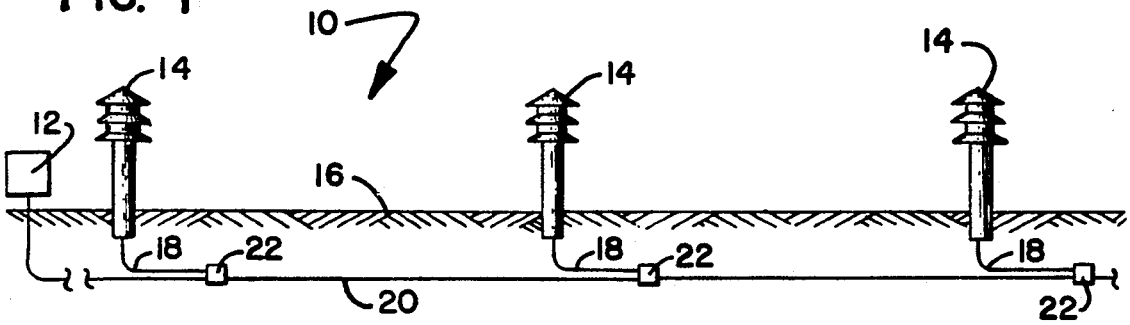
FIG. 1 is a side elevational view of a typical low voltage outdoor lighting system.

In the Drawings, wherein like reference numerals designate like parts and assemblies throughout the several views, FIG. 1 shows a side elevational view of a typical low voltage outdoor lighting system 10. The system includes an electrical power transformer 12 for transforming standard household alternating electrical current to low voltage (typically 12 volts) alternating current. The transformer is typically mounted on the outside wall of a home. The system also includes one or more lighting fixtures 14 which are implanted into the ground 16 as a means of securing the fixture in the outdoor environment. Each fixture 14 is electrically connected to the power transformer 12 by means of a light fixture feeder cable 18 which is connected to a main cable 20 running from the transformer 12. The physical and electrical connection of the feeder cable 18 and the main cable 20 is accomplished by a preferred cable connector 22.

Figure 2:
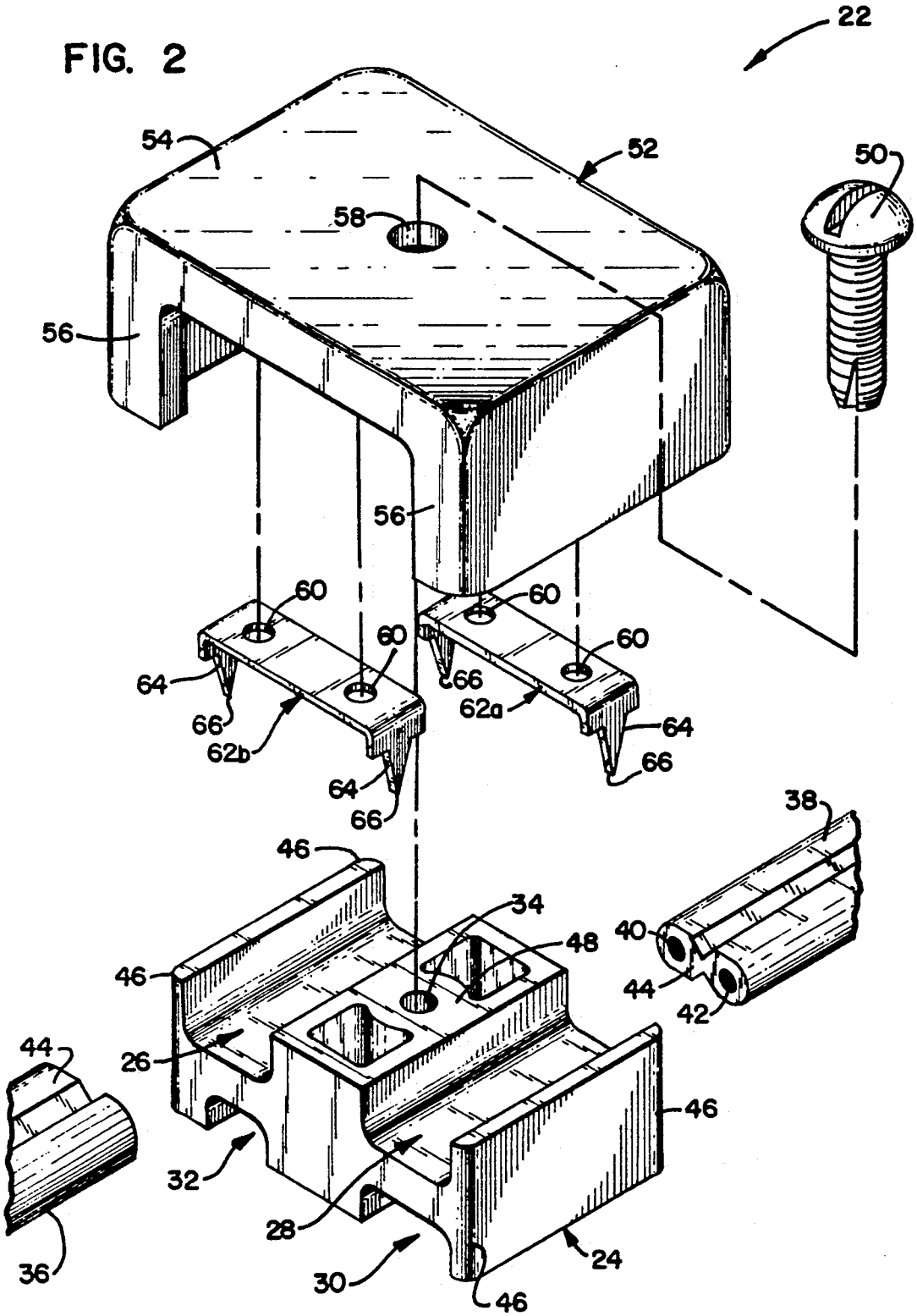
FIG. 2 is an exploded view of a preferred cable connector according to the present invention.

FIG. 2 shows an exploded view of the cable connector 22. Cable connector 22 includes a base 24 which is constructed out of an electrically resistive material such as polyphenylene oxide sold under the brand name Noryl. Base 24 is configured as a rectangular-shaped block, including four cavity-like channels 26, 28, 30, 32, each of which is formed in base 24 wherein channels 26 and 28, being of equal width and depth run parallel to each other along one side of base 24 and wherein channels 30 and 32 being of unequal width and depth, run off-parallel to each other along the opposite side of base 24. Channels 26 and 28 are sized so as to allow cables 36 and 38 to fit snugly within channels 26 and 28, respectively. Cables 36 and 38 are of equal size. Each cable consists of two conductors, 40 and 42, both of which are typically multistranded wire conductors and are surrounded by electrically insulating material 44. Conductor 40 is either hot or neutral, the other conductor 42 is electrically charged opposite to conductor 40. Channels 26 and 28 are typically sized so as to fit double conductor cables of the size designated as "16 Gauge". Channel 30 on the opposite side of the base is also sized to fit 16 gauge double conductor wire. Channel 32 is sized for a smaller double conductor wire, typically an "18-gauge" designation. Channel 32 also runs off parallel in relation to channels 26, 28 and 30 for reasons that will be discussed below. Base 24 includes a hole 34 that extends through base 24 and is centered between the four corners 46 of base 24 and extends perpendicular from surface 48 of base 24. Hole 34 is typically sized so as to allow thread cutting and engagement of a self-tapping sheet metal screw 50. Other fasteners could be utilized in place of the self-tapping sheet metal screw 50.

Cable connector 22 also includes a cap 52 which is constructed out of an electrically resistive material such as polyphenylene oxide sold under the brand name of Noryl. Cap 52 consists of a generally channel-like cross-section with a top surface 54 and legs 56. Cap 52 includes a hole 58 sized to allow clearance of self-tapping sheet metal screw 50. Cap 52 is sized so as to allow base 24 to fit snugly or "nest" within legs 56 of cap 52 and to allow alignment of hole 58 and hole 34 for self-tapping sheet metal screw 50. Base 24 is drawn up into legs of cap 52 by the tightening of self-tapping sheet metal screw 50 as it is tightened through holes 58 and 34 as it cuts threads into base 24. Cap 52 also includes protrusions 64 (see FIGS. 3A and 4A) for frictionally engaging holes 60 of a pair of electrically conductive jumper strips **62*a* or 62*b***.

Electrically conductive jumper strips **62*a* and 62*b* consist of strips of electrically conductive material such as phosphor bronze that are formed in a generally channel-like cross-section. Jumper strips 62*a* and 62*b* include holes 60 that are sized so as to frictionally engage protrusions 64 (see FIGS. 3A and 4A) molded into cap 52. In addition to the frictional engagement between protrusions 64 and holes 60 of jumper strips 62*a* and 62*b*, the protrusions 64 are swaged so as to permanently lock in jumper strips 62*a* and 62*b*. Jumper strips 62*a* and 62*b* include channel legs 64 that, in turn, include sharp protrusions 66 terminating in points at end of legs 64. Jumper strips 62*a* and 62*b* are mounted to cap 52 wherein jumper strip holes 60 frictionally engage protrusions 66 (see FIGS. 3A and 4A) integral to cap 52 and wherein strips 62*a* and 62*b* are thus mounted so that points 66 protrude into mating base channels 26, 28, 30 or 32 when base 24 is drawn into cap 52 by self-tapping sheet metal screw 50. Jumper strips 62*a* and 62*b* must be precisely located with cap 52 so that points 66 protrude into channel cavities 26, 28, 30, 32 so as to pierce through the insulating material 44 of cable 36 or 38, which are set in channels 26, 28, 30 or 32, to the point of contacting conductive material 40 or 42 at core of cable 36 or 38. When cables 36 and 38 are placed in channels 26 or 28 of base 24 and when cap with jumper strips 62*a* and 62*b* and base 24 are pulled together by self-tapping sheet metal screw 50, the sharp protrusions 66 of jumper strips 62*a* and 62*b* are forced through insulating material 44 of cables 36 and 38. The sharp protrusions 66 of jumper strips 62*a* and 62*b* pierce through insulating material 44 of cables 36 and 38 and thus contact the conductive cores 40 and 42 of cables 38 and the conductive cores of cable 36. The base 24 "nests" within cap 52; that is, the base 24 is sized so as to not only fit snugly within the cap 52 but also to maintain the snug fit and alignment throughout the sliding engagement of base 24 into cap 52 as base 24 is drawn into cap 52 by fastener 50. The "nesting" of base 24 within cap 52 assures proper alignment of the cables 36 and 38 with the sharp protrusions 66 of jumper elements 62*a* and 62*b* as the base 24 is drawn up into the cap 52. This alignment is achieved, due to the channel-like construction of cap 52** and the corresponding snug fit of base 24, well before the cables 36 and 38 contact the sharp protrusions 66 of jumper elements 62*a* and 62*b* as the base 24 is drawn up into the cap 52 by fastener 50. As described above, the jumper strips 62*a* and 62*b* and their integral sharp protrusions 66 are located upon the cap 52 so that the protrusions 66 and jumper strips 62*a* and 62*b* contact and transfer the electrical charges of one cable to the other cable.

Figure 3A:
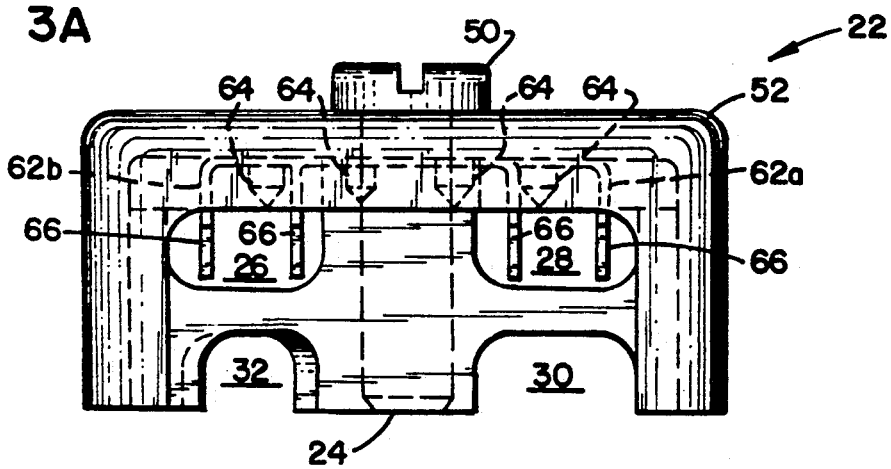
FIG. 3A is a front elevational view of the cable connector of FIG. 2 wherein the cable connector is assembled so as to connect cables of identical size--gauge.
Figure 3B:
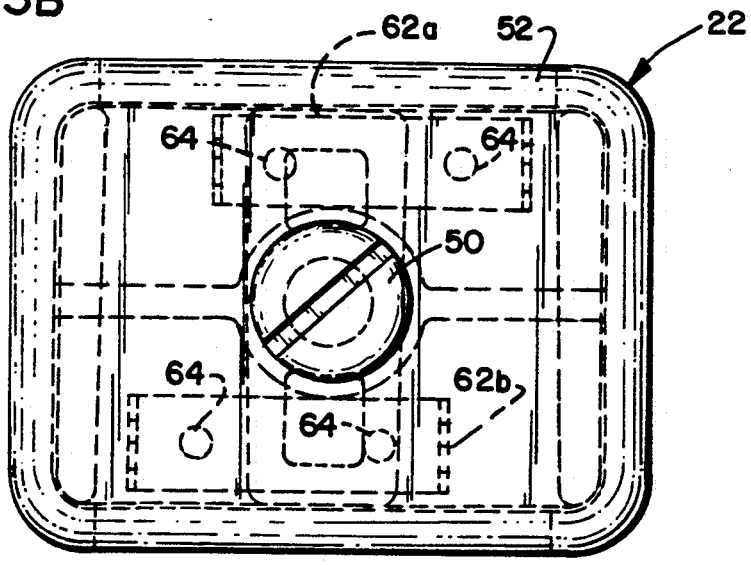
FIG. 3B is a top plan view of the cable connector of FIG. 2, wherein the cable connector is assembled so as to connect cables of identical size--gauge.

FIGS. 3A and 3B depict front elevational and top plan views, respectively, of cable connector 22. FIGS. 3A and 3B show the cable connector assembled so as to physically and electrically connect two low voltage lighting cables of the same size—gauge. Channels 26 and 28 of base 24 face the cap 52 and protrusions 66 of jumper strips 62*a* and 62*b* extend into channels 26 and 28 of base 24. Protrusions 66 extend into channels 26 and 28 so as to contact the cables that are set in channels 26 and 28 in such a manner so that the protrusions 66 pierce the insulating material of the cable to the point of contacting the conductive core of the cables. Such contact of the cable's conductive core by the protrusions 66 of the jumper strips 62*a* and 62*b* establishes electrical contact between the two cables. The physical tightening of the self-tapping sheet metal screw physically connects the cables.

Figure 4A:
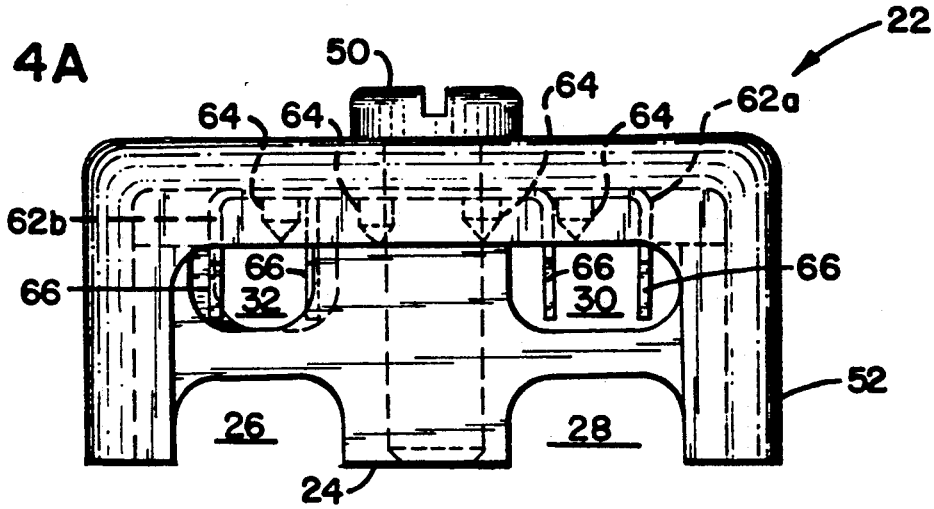
FIG. 4A is a front elevational view of the cable connector of FIG. 2 wherein the cable connector is assembled so as to connect cables of different size--gauge.
Figure 4B:
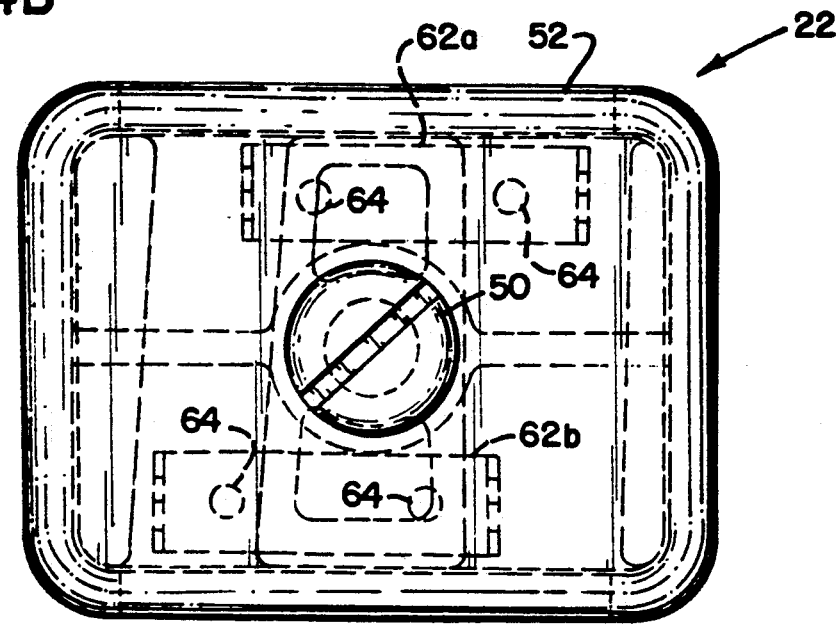
FIG. 4B is a top plan view of the cable connector of FIG. 2, wherein the cable connector is assembled so as to connect cables of different size--gauge.

FIGS. 4A and 4B depict front elevational and top plan views, respectively, of cable connector 22. FIG. 4A and 4B show the cable connector 22 assembled so as to physically and electrically connect two low voltage lighting cables of different size-gauge. Channel 32 is smaller in width and depth than channel 30. Channel 32 also runs off-parallel in relation to channel 30 which runs parallel to the sides of base 24 and the channels on the opposite side of base 24. Channels 32 and 30 on base 24 face, in this assembly mode, cap 52 and protrusions 66 of jumper strips 62*a* and 62*b* extend into channels 32 and 30 fo base 24. Protrusions 66 extend into channels 32 and 30 so as to contact the low voltage electrical cables that are set in channels 32 and 30 in such a manner so that the protrusions 66 pierce the insulating material of the cables to the point of contacting the conductive core of the cables. Such contact of the cable's conductive core by the protrusions 66 of the jumper strips 62*a* and 62*b* establishes electrical contact between the two cables. The physical tightening of the self-tapping sheet metal screws physically connects the cables. Channel 32 lies off-parallel in relationship to channel 30 within base 24 so that the narrower width—smaller gauge cable set in channel 32 is properly aligned with the protruding sharp points 66 of jumper strips 62*a* and 62*b*.

A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only to the apparatus, and method recited in the following claims, and equivalents thereof.

We claim:

1. A low voltage cable connector for mechanically and electrically interconnecting a pair of low voltage electrical cables, said cables comprising electrically conductive material encased in electrically insulating material, said connector comprising:

(a) a pair of electrically conductive jumper elements, wherein each of said elements comprises a pair of spaced sharp protrusions wherein said sharp protrusions are electrically connected;

(b) a cap comprising electrically resistive material with means for engaging said electrically conductive jumper elements;

(c) a base comprising electrically resistive material with a plurality of channel-like cavities for accepting said electrical cables and wherein said base is sized so as to nest within said cap and wherein said cavities on said base are positioned so as to receive said protrusions such that said cables are penetrated by said protrusions when said base nests within said cap; and (d) fastening means for retaining said cap to said base wherein said protrusions penetrate said insulating material and make electrical contact with said conductive material of said cables, wherein said base comprises a generally rectangular-like cross section and wherein said base comprises four said cavities,two of said cavities of equal width and depth for accepting cable of equal size, extending parallel to each other on one side of said base, and two of said cavities of unequal width and depth for accepting cable of unequal size extending off-parallel to each other along opposite side of said base; and wherein said base nests within said cap so that either set of said cavities will receive said protrusions of said elements engaged in said cap.

2. A low voltage electrical system having a power source, one or more low voltage devices, a pair of low voltage electrical cables, said cables comprising electrically conductive material encased in electrically insulating material, said cables connecting said power source to said low voltage electrical devices and one or more low voltage cable connectors connecting said low voltage electrical cables to additional said cables, wherein said cable connector comprises:

(a) a pair of electrically conductive jumper elements, wherein each of said elements comprises a pair of spaced sharp protrusions wherein said sharp protrusions are electrically connected;

(b) a cap comprising electrically resistive material with means for engaging said electrically conductive jumper elements;

(c) a base comprising electrically resistive material with a plurality of channel-like cavities for accepting said electrical cables and wherein said base is sized so as to nest within said cap and wherein said cavities on said base are positioned so as to receive said protrusions such that said cables are penetrated by said protrusions when said base nests within said cap; and (d) fastening means for retaining said cap to said base wherein said protrusions penetrate said insulating material and make electrical contact with said conductive material of said cables, wherein said base comprises a generally rectangular-like cross section and wherein said base comprises four said cavities, two of said cavities of equal width and depth for accepting cable of equal size, extending parallel to each other on one side of said base, and two of said cavities of unequal width and depth for accepting cable of unequal size extending off-parallel to each other along opposite side of said base; and wherein said base nests within said cap so that either set of said cavities will receive said protrusions of said elements engaged in said cap.

3. A low voltage cable connector for mechanically and electrically connecting a pair of low voltage electrical cables, said cables comprising electrically conductive material encased in electrically insulating material, said connector comprising:

(a) a pair of electrically conductive jumper elements wherein each of said elements comprises a pair of spaced sharp protrusions wherein said sharp protrusions are electrically connected;

(b) a cap comprising electrically resistive material with means for engaging said electrically conductive jumper elements;

(c) a base comprising electrically resistive material with a plurality of channel-like cavities for accepting said electrical cables and wherein said base is sized so as to nest within said cap and wherein said cavities on said base are positioned so as to receive said protrusions such that said cables are penetrated by said protrusions when said base nests within said cap in first or second orientation in relation to said cap and wherein said connector accepts cables of equal size in said first orientation and said connector accepts cables of unequal size in said second orientation; and (d) fastening means for retaining said cap to said base, wherein said protrusions penetrate said insulating material and make electrical contact with said conductive materials of said cables.

* * * * *